United States Patent [19]

Kohn

[11] Patent Number: 4,844,658

[45] Date of Patent: Jul. 4, 1989

[54] APPARATUS FOR BURYING PIPE UNDER WATER

[75] Inventor: Robin J. Kohn, Phoenixville, Pa.

[73] Assignee: Henkels & McCoy, Inc., Blue Bell, Pa.

[21] Appl. No.: 107,232

[22] Filed: Oct. 9, 1987

[51] Int. Cl.[4] ..... F16L 1/04

[52] U.S. Cl. ..... 405/159; 405/164; 405/184

[58] Field of Search ..... 405/154, 159, 164, 184, 405/174, 180

[56] References Cited

U.S. PATENT DOCUMENTS

| | | | |
|---|---|---|---|
| 188,149 | 3/1877 | Kline | 405/184 |
| 996,866 | 7/1911 | Lilly | 405/184 |
| 1,765,185 | 6/1930 | Umbarger | 405/184 X |
| 1,808,974 | 6/1931 | Wilkens | 405/184 |
| 1,817,792 | 8/1931 | Yares | 405/184 |
| 3,181,301 | 5/1965 | Davis | 405/159 |
| 4,448,567 | 5/1984 | Tsuda | 405/184 X |

*Primary Examiner*—David H. Corbin

*Attorney, Agent, or Firm*—Caesar, Rivise, Bernstein, Cohen & Pokotilow, Ltd.

[57] ABSTRACT

A sled device for burying a pipe within the ground under water. The sled is arranged to be pulled over the ground and includes a blade adjustably mounted within a tower in the sled. The blade is arranged to cut a furrow in the ground as the sled is pulled thereacross and to pull a pipe, which is connected to the lower end of the blade, into the furrow. A mandrel assembly, including a cylindrical member located in front of the leading edge of the pipe is tethered to the blade to enlarge the diameter of the furrow as it is cut so that the pipe can be readily pulled therethrough. The mandrel also protects the pipe from impact by buried obstacles. The mandrel assembly is releasably secured to the lower end of the blade by a releasable means including a crank assembly.

19 Claims, 4 Drawing Sheets

22
26
30
32
34
36
38
40
6
98
100
106
108
110
112
114
116
118
120
122
124
126
128
130
132
134
136
138
140
142

APPARATUS FOR BURYING PIPE UNDER WATER

BACKGROUND OF THE INVENTION

This invention relates generally to apparatus for burying pipe and more particularly to apparatus for traversing marshes, streams or other bodies of water to bury a pipe within the ground under that body of water.

In order to bury a pipeline in the ground under a body of water, it had heretofore been a practice to cut a ditch in the ground under the water, insert the pipe in the ditch and thereafter fill the ditch. This three-step technique is no longer acceptable in many areas due to environmental concerns, e.g., digging the ditch and then thereafter filling it frequently resulted in death or injury to fish or other wildlife in the water.

Another technique used heretofore for burying pipelines under water is through the use of a sled-type device having a plow blade mounted to project downward thereunder. The sled is arranged to be towed across the ground under the water so that the downwardly projecting blade cuts a furrow in the ground. The pipe is connected via a chain or cable to the blade so that it is pulled through the furrow as the furrow is cut. This technique, while obviating some of the ecological problems of the prior art three-step process, nevertheless leaves much to be desired. In this connection, it is difficult to drag the pipe through the furrow (which when cut is somewhat narrow to minimize the disturbance of the soil as the blade cuts it). In addition, the pipe is susceptible to damage or scoring as it is dragged through the furrow. Such damage and/or scoring can be caused by impacting buried obstacles, e.g., rocks. Moreover, the prior art sled is quite large in size and cumbersome to maneuver and also is of limited application, inasmuch as its blade height is fixed. Thus, the depth of the furrow which is cut by the blade cannot be adjusted to accommodate various terrain. Moreover, a further limitation on the usefulness of the prior art sled is that it requires excavation of the soil down to the location of the pipe to uncouple the pipe from the sled so that the sled can be taken away after the pipe is in place.

OBJECTS OF THE INVENTION

Accordingly, it is a general object of this invention to provide apparatus which overcomes the disadvantages of the prior art.

It is a further object of the instant invention to provide a sled for traversing marshes, streams or other bodies of water to bury a pipe therein and which enables the adjustment of the depth to which the pipe is buried.

It is still a further object of the instant invention to provide apparatus for burying pipe under a marsh, stream or other water body and which includes means for facilitating the insertion of the pipe therein without damage thereto.

It is yet a further object of the instant invention to provide apparatus for burying pipe under a marsh, stream or other body of water and which apparatus is reasonably maneuverable.

It is still a further object of the instant invention to provide a relatively small, reasonably maneuverable apparatus for burying a pipe under a marsh, stream or other body of water and which apparatus is arranged to be towed in one direction or in an opposite direction across that body of water.

SUMMARY OF THE INVENTION

These and other objects of the instant invention are achieved by providing apparatus for inserting a pipe within the ground under water. The pipe includes a leading end. The apparatus comprises carrier means for traversing the ground. The carrier means comprises blade means and mandrel means. The blade means has an upper end and a lower end and is mounted on the carrier means and projects downward therefrom so that the lower end engages the ground to cut a furrow therein as the carrier means traverses the ground. The mandrel means comprises a body member having an exterior surface and which is tethered to the lower end of the blade means so that the blade means drags the mandrel through the furrow, whereupon the exterior surface of the mandrel means enlarges the furrow. The pipe is tethered at its leading end to the mandrel means so that it is pulled into the enlarged furrow behind the mandrel means.

In accordance with one aspect of the invention, the blade means is adjustably mounted so that the extent to which its lower end projects under the carrier means can be established as desired.

In accordance with another aspect of the invention, the blade means can be reversed so that the apparatus can be pulled in either one of two opposite directions across the ground to cut the furrow and insert a pipe therein.

In accordance with another aspect of the invention, the mandrel means is secured to the blade means by releasable securement means located adjacent the upper end of the blade means so that upon the release thereof the apparatus can be moved away from the inserted pipe.

DESCRIPTION OF THE DRAWING

Other objects and many of the attendant advantages of this invention will be readily appreciated as the same becomes better understood by reference to the following detailed description when considered in connection with the accompanying drawing wherein.

DETAILED DESCRIPTION OF THE PREFERRED EMBODIMENT

Figure 1:
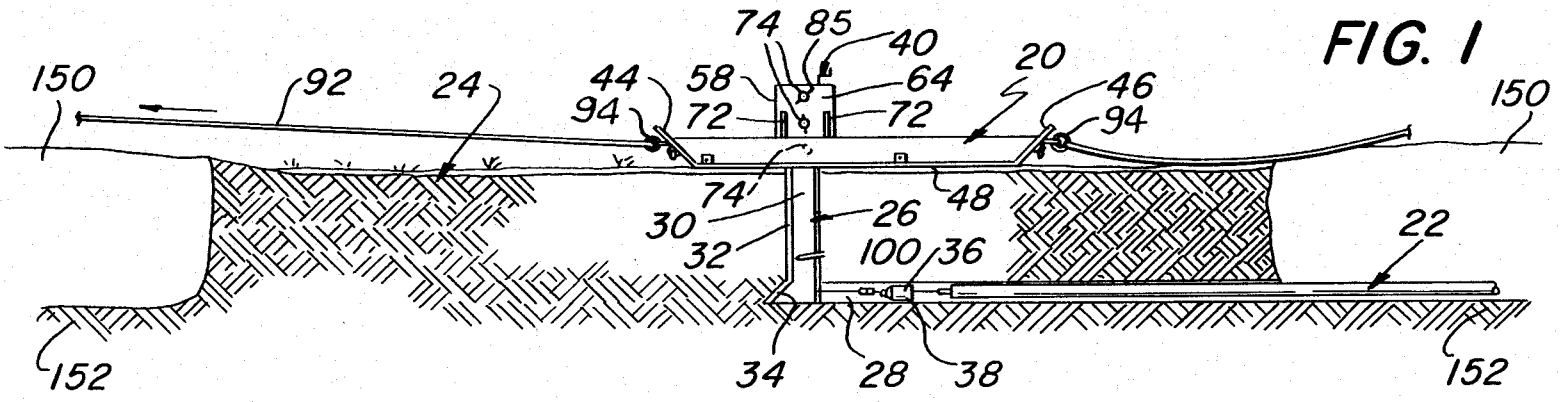
FIG. 1 is a side elevational view, partially in section, showing the apparatus of the subject invention cutting a furrow for burying a pipe or other elongated member in the ground under water.

Referring now to the various figures wherein like reference characters refer to like parts, there is shown apparatus 20 for burying a pipe 22 or some other elongated member, e.g., a cable, in the ground under a marsh 24, stream, pond or other body of water. The apparatus 20 basically comprises a sled-like member which is arranged to slide across the ground 24 in which the pipe 22 is to be buried, with the sled being either partially or fully submerged (depending upon the depth of the water on the ground). A blade assembly 26 is adjustably mounted on the sled and arranged to cut a furrow 28 in the ground below the sled and to drag the pipe 22 therethrough as the sled is pulled across the ground to be traversed.

The blade assembly 26 will be described in considerable detail later. Suffice it for now to state that it includes an elongated blade member 30 having a tapered leading edge 32 which is hardened. The lower end of the blade includes a projecting, pointed, cutting face 34. The blade is adjustably mounted in a blade well (to be described later) of the sled so that its cutting face 34 can be made to extend a sufficient distance below the bottom of the sled to cut the furrow 28 in the ground at the desired depth as the sled is pulled thereacross.

The apparatus 20 also includes a mandrel assembly 36 which is tethered to the lower end of the blade 30 and which, in turn, is secured to the leading end of the pipe 22. The mandrel assembly will also be described in detail later. Suffice it for now to state that the mandrel assembly includes a mandrel element 38 in the form of a cylindrical body 38 which is configured so that as it is dragged through the furrow 28 immediately behind the blade 30 it shapes and enlarges the diameter of the furrow. Accordingly, the pipe 22 can be readily pulled through the enlarged furrow without interference or damage caused by obstacles which may be buried in the ground.

The apparatus 20 also includes a releasable securement assembly 40 to release the mandrel assembly 36 and the pipe 22 connected thereto from the sled when such action is desired, e.g., when it is desired to move the sled away after the pipe has been buried.

Figure 2:
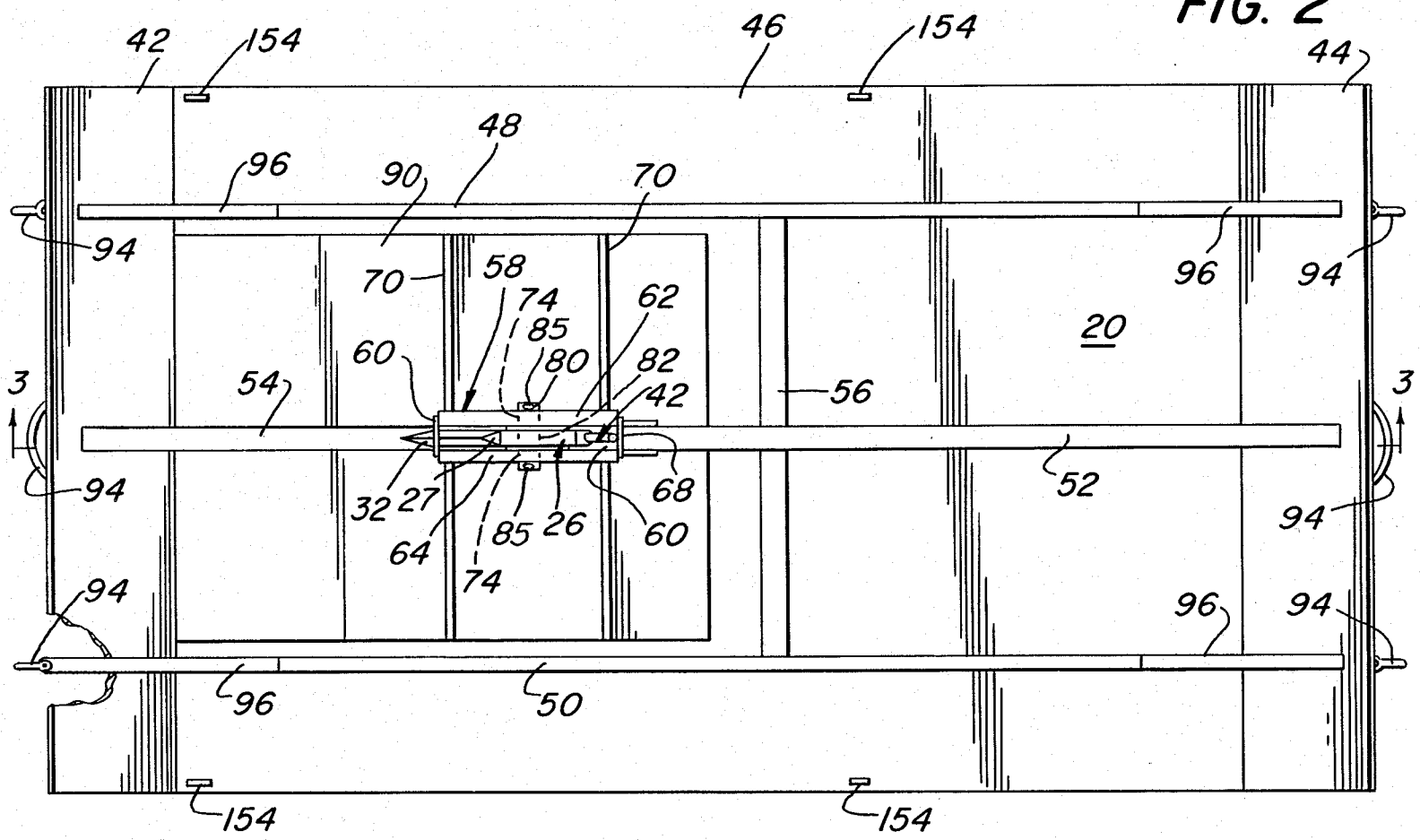
FIG. 2 is an enlarged plan view, partially in section, of the apparatus shown in FIG. 1.
Figure 3:
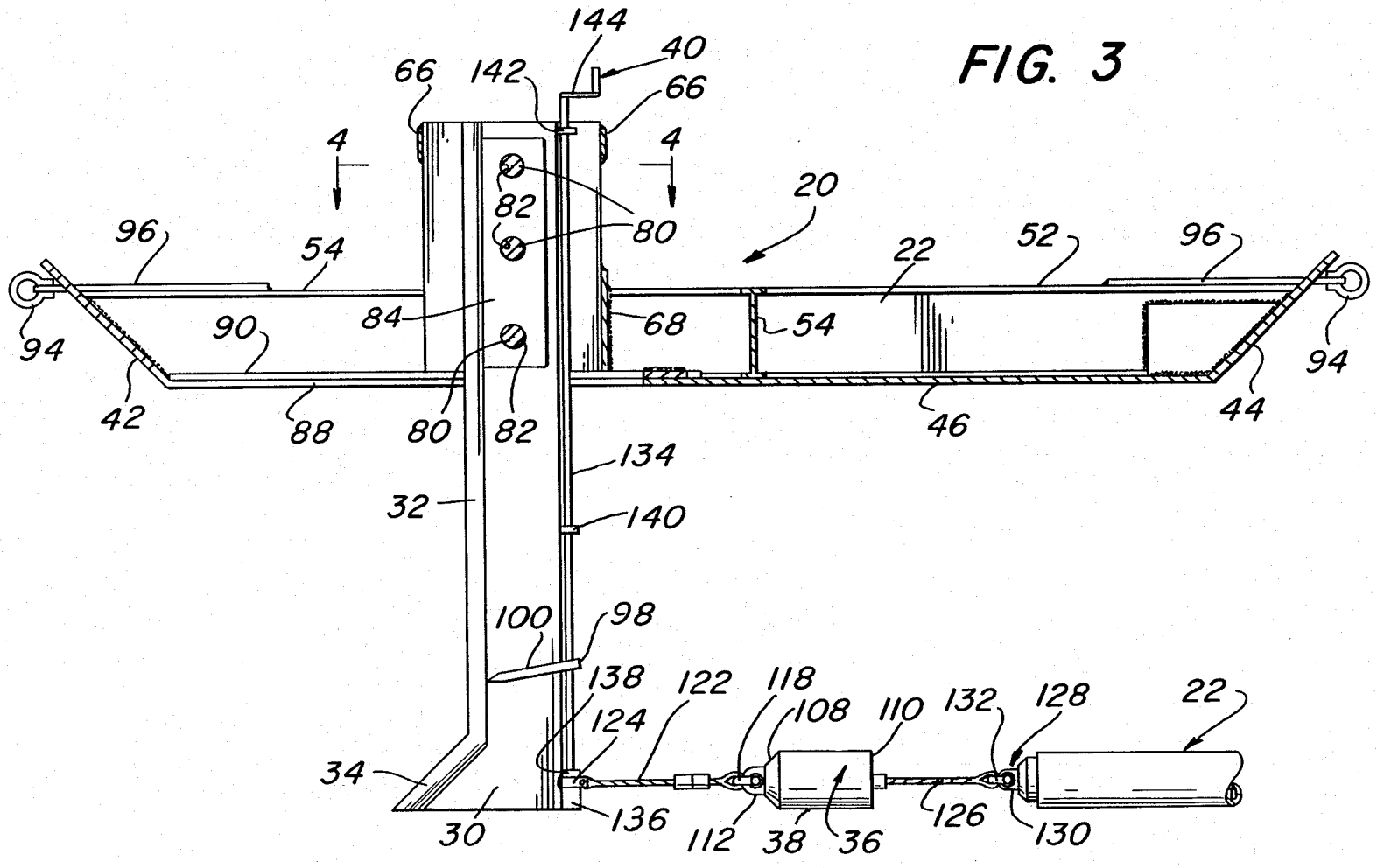
FIG. 3 is a sectional view taken along line 3—3.

Referring now to FIGS. 1, 2 and 3, the details of the sled will be described. As can be seen, the sled includes a prow in the form of a rectangularly shaped, sloped wall 42, a stern in the form of a similarly shaped sloped rear wall 44, and a rectangularly shaped bottom wall 46 interconnecting the bottom edges of the front and rear walls. The walls serve as the surfaces which slide over the ground as the sled is towed across it. The sled also includes a pair of "I" beams 48 and 50. The beams are disposed parallel to each other but spaced inward from the marginal edge of the bottom wall. In the preferred embodiment of this invention, the sled's walls and beams are formed of steel and are welded to one another to complete the structure. The sled also includes a pair of axially aligned, central I beams 52 and 54. These beams are spaced apart to provide a passageway for the blade to pass therethrough, as will be described later. The two I beams 52 and 54 are also welded in place to the sled's walls. The sled also includes another I beam 56 extending transversely across the sled between the two side beams 48 and 50 and is also welded in place.

The beams serve to reinforce the sled and to provide adequate support for a blade tower 58. The blade tower 58 is formed of a pair of heavy plates (to be described later) which are mounted vertically and parallel to each other but spaced apart to define a vertically oriented blade well 60 in which the blade 30 is mounted. Owing to the construction of the blade tower and its well, the blade 30 can be adjusted to various vertical positions with respect to the sled. Moreover, the direction that the blade faces can be reversed from front to back, so that its cutting face 34 may either point toward the prow or the stern. By providing for such adjustability of the blade, the sled can be used in various conditions of service to cut the furrow in either of two directions diametrically opposite across a body of water. Thus, the use of the terms "prow" and "stern" as used with respect to the sled is in no means limiting since the sled may be pulled in either direction across the water, so that either end of the sled can be the prow while the other end is the stern.

Figure 4:
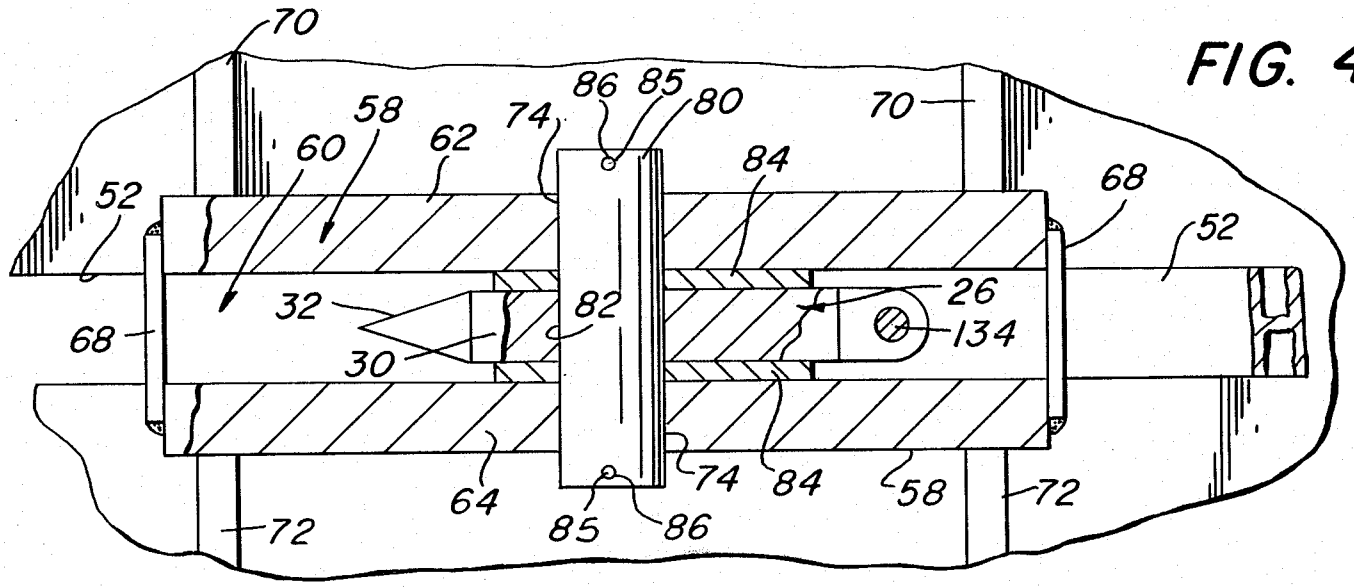
FIG. 4 is an enlarged sectional view taken along line 4—4 of FIG. 3.

As can be seen in FIGS. 2, 3 and 4, the blade tower 58 comprises a pair of vertically disposed plates 62 and 64. The plates are generally rectangular members which are spaced from one another by a distance just slightly thicker than the thickness of the blade 30 to define the heretofore identified blade well 60. The vertical edges of the two plates 62 and 64 are secured together adjacent their top end by an opposed pair of welded straps 66 and at their bottom end by an opposed pair of welded straps 68. The two plates 62 and 64 are supported in their vertical orientation by respective pairs of angle plates or gussetts. Thus, a pair of generally triangularly shaped gussetts 70 are welded to the outer surface of the vertical plate 62 and to the upper surface of a reinforcing plate (to be described later) mounted on the top surface of the bottom plate 46. A similar pair of triangular gussetts 72 are welded to the outer surface of the plate 64 and the upper surface of the reinforcing plate.

As can be seen in FIGS. 1, 2 and 4, the plates 62 and 64 forming the tower include plural axially aligned openings 74 therein. These openings cooperate with mounting pins 80 (to be described later) to serve as the mounting mean for supporting the blade 30 at its desired vertical position in the blade well. Thus, in the embodiment shown herein, the blade tower includes three pairs of aligned openings 74 in plates 62 and 64 which are arranged to receive respective pins 80 therein. Each of the pins is, in turn, arranged to extend through an associated opening 82 in the blade 30. In the embodiment shown herein, the blade also includes three openings 82 spaced apart by the same distance as the openings 74 in the blade tower. Obviously, additional openings can be provided in the blade and/or blade tower so that further vertical adjustability of the blade can be effected.

While any number of mounting pins 80 can be used, it is recommended that the blade be supported by at least two pins in order to prevent it from pivoting or otherwise skewing in the tower during a plowing operation. Moreover, it is recommended that the blade be reinforced adjacent its openings 82. Hence, a pair of reinforcing plates 84 are welded to the opposite sides of the blade 30 adjacent the openings 82. The reinforcing plates each include openings aligned with openings in the blade.

Each of the mounting pins 80 are arranged to be locked in place in the tower openings by respective pairs of locking pins 85. In particular, the locking pins extend through openings 86 at each end of the mounting pins.

As can be seen in FIG. 3, the blade 30 extends out through the bottom of the sled via a slot 88 in the bottom wall 46. A reinforcing plate 90 having a similar slot is welded to the top surface of the bottom wall 46 to serve as further means for reinforcing the support for the blade tower.

As noted earlier, the sled 22 is arranged to be towed or pulled across the ground to be plowed. This is accomplished through the use of one or more towing cables or chains 92. In practice, it is desirable to utilize more than one towing cable 92. Thus, each end of the sled includes three eyelets or clevises 94 which are fixedly secured, such as by welding, to the ends of the center beams 52 and 54 and the ends of the side beams 48 and 50 (see FIG. 2). The four eyelets attached to the side beams each include a mounting strip 96 which extends through an opening in the sled's associated sloped wall 42 or 44 and is welded to the top of the beam 48 or 50, contiguous therewith. The two center eyelets 94 are connected to the ends of the beams 54 and 50 which extend out of the plates 42 and 44, respectively.

In order to ensure that the blade 30 does not tend to ride up out of the ground from the desired depth as the sled is dragged across the ground, the blade includes a diving plane 48 having a pair of slightly downwardly sloped fins 100. These fins serve to guide the blade downward against its tendency to ride up during plowing. As will be appreciated by those skilled in the art, the bottom of the sled acts as a stop against excessive penetration of the blade into the ground while the diving plane prevents the blade from riding up out of the ground. Thus, the fins and sled bottom cooperate to ensure that the furrow 28 is cut accurately at the desired depth.

Figures 5, 6:
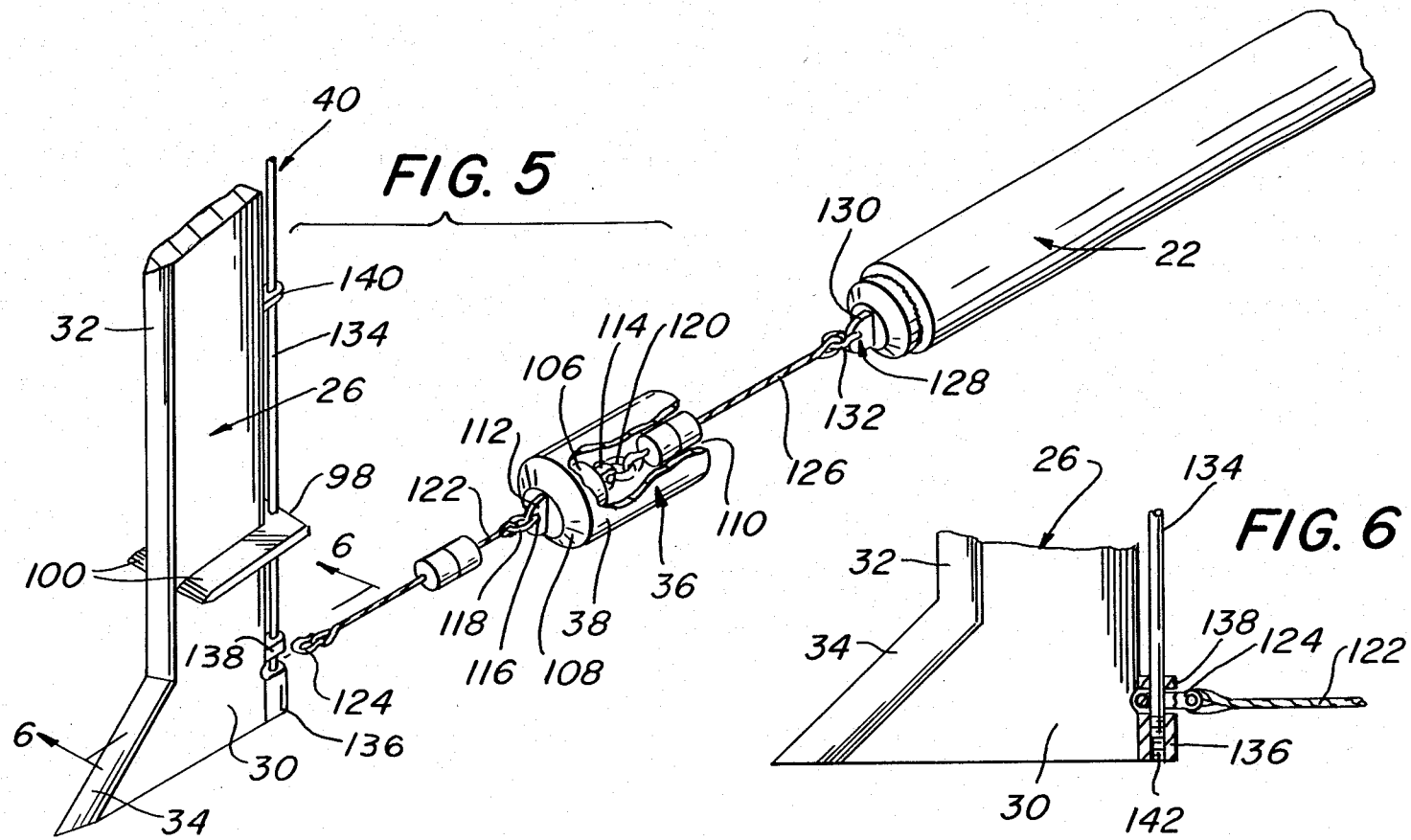
FIG. 5 is an enlarged perspective view of a portion of the apparatus shown in FIG. 1.
FIG. 6 is an enlarged sectional view taken along line 6—6 of FIG. 5.

Referring now to FIGS. 3, 5 and 6, the details of the mandrel assembly 36 will now be described. As can be seen, the mandrel assembly 36 basically comprises the heretofore identified body 38 and a connector 106. The body 38 is of a hollow cylindrical shape and includes a tapered leading end wall 108 and an opened trailing end 110. The connector 106 is mounted on the leading end wall and includes a flanged portion 112 projecting outward from the front thereof and a flange portion 114 projecting rearward from the rear thereof and located within the interior of the mandrel's body. The flange 112 includes an opening through which a pin 116 extends. The pin pivotably connects a clevis 118 to the flange. A similar clevis 120 is pivotably connected to the flange 114. The clevis 118 serves as means for connecting the mandrel assembly 36 to the lower portion of the blade 30. This connection is accomplished by the use of a cable or chain 122. Thus, the trailing end of the cable (or chain) is pivotably connected via a loop, to the clevis 118 while the forward end of the cable (or chain) includes a loop to which is pivotably connected another clevis 124 The clevis 124 is arranged to be releasably secured to a portion of the releasable securement means 40, in a manner to be described later.

The pipe 22 is connected to the clevis 120 via another cable or chain 126 which is constructed similarly to the cable (or chain) 122. The cable (or chain) 126 is thus pivotably connected at its forward end to the clevis 120 of the mandrel assembly 38. The trailing end of cable (or chain) 126 is pivotably connected to a coupling 128 secured to the leading end of the pipe 22. The coupling 128 is a generally cylindrical member extending partially into the interior of the leading end of the pipe 22 and is fixedly secured in place therein, such as by a weld line. The coupling 128 also includes a flange 130 having an opening therein through which a pin extends. The pin serves to pivotably mount another clevis 132 onto the flange. The trailing end of cable (or chain) 126 is pivotably connected, via a loop, to the clevis 132.

As mentioned earlier, the function of the mandrel assembly 36 is to enlarge the furrow 28 cut by the blade 30 so that the trailing pipe 22 can pass freely therethrough and be protected from damage from impacting any buried obstacle. To that end, the outside diameter of the cylindrical body 38 is slightly greater than the outside diameter of the pipe 22. The body 38 is also formed of a tough, impact-resistant material, such as steel.

In order to release the mandrel assembly 28 and the pipe 22 connected thereto from the blade 30 so that the sled 20 can be moved away, such as is required after the pipe has been pulled to its desired location, e.g., to the other side of the swampland to be bridged, the sled 20 includes the heretofore identified releasable securement assembly 40. That assembly is shown clearly in FIGS. 3, 5 and 6 and basically comprises an elongated shaft 134 extending the length of the blade 30 along its trailing edge from the top of the blade to the bottom. The shaft 134 is journaled within plural mounts 136, 138, 140 and 142 projecting rearward from the trailing edge of the blade. The mount 136 is located contiguous with the lowermost end of the blade, with the mount 138 spaced slightly thereabove by a distance just slightly greater than the thickness of the clevis 124. The mount 140 is located at approximately a mid-point along the length of the blade, while the mount 142 is located immediately adjacent the top end thereof. Each of the mounts includes an opening through which the shaft 134 extends. The openings in mounts 138, 140 and 142 are all smooth walled, whereas the opening in mount 136 is threaded. A smooth walled opening also extends through the diving plane 108 so that the shaft 134 extends therethrough. As can be seen in FIG. 6, the lowermost end of the shaft 134 is threaded at 142. These threads mate with the threads in the hole in the mount 136. The upper end of the shaft 134 includes a crank 144.

The mandrel assembly 38 is releasably secured to the blade by placing the clevis 124 into the space between mounts 136 and 138 and thereafter extending the shaft 134 through the aligned openings in mounts 138 and 136 while rotating the crank 144 so that the threads 142 on the shaft engage the threads within mount 136. Once the threads are sufficiently engaged, the shaft is held in place against upward movement so that the mandrel assembly 38 is secured against accidental disconnection from the blade. The sled is now ready for use. When the wetland 22 has been traversed so that the leading end of the pipe 22 is now located at an exposed open ditch 150 in dry land 152, the shaft's crank 144 is rotated in the opposite direction so that its threads 142 disengage from the threads in the mount 136. The shaft can then be pulled upward (along its longitudinal axis) so that its lower end no longer extends through the clevis 124. The sled can then be moved away leaving the mandrel assembly and its connected pipe in place. The pipe can then be freed from the mandrel assembly by cutting the coupling 128 away from the pipe.

In order to lift the sled, as may be desired to transport it to a working site, it includes plural lifting lugs 154.

As should be appreciated from the foregoing, the sled of the subject invention is simple in construction, is adapted for use in various conditions of service, e.g., various depths of penetration, can plow in both directions over wetlands and provides means for effectively protecting the pipe as it is pulled in place through the furrow, while also enlarging the furrow to facilitate the burial procedure.

It must be pointed out at this juncture that while the sled has been shown and described for pulling a pipe through a furrow cut by the sled's blade, it should be clear to those skilled in the art that other elongated members, e.g., cables, etc. can also be pulled through a furrow cut by the blade of the sled of this invention.

Without further elaboration, the foregoing will so fully illustrate my invention that others may, by applying current or future knowledge, adopt the same for use under various conditions of service.

What is claimed is:

1. Apparatus for inserting a pipe within the ground under water or a marsh, said pipe having a leading end, said apparatus comprising carrier means for movement across the ground surface, said carrier means comprising blade means and mandrel means, said blade means having and upper end and a lower end and being mounted on said carrier means and projecting downward therefrom so that said lower end engages the ground under said water or marsh to cut a furrow therein as said carrier means traverses said ground, said mandrel means comprising a member having an exterior surface and being tethered to the lower end of said blade means so that said blade means drags said mandrel means through said furrow, whereupon said exterior surface of said mandrel means enlarges said furrow, said pipe being tethered at the leading end thereof to said mandrel so that said pipe is pulled into said enlarged furrow behind said mandrel, said mandrel means being releasably secured to said blade means by actuatable releasably securable means, said actuatable releasably securable means comprising an actuating member located adjacent said upper end of said blade means and operative when actuated to effect the disconnection of said mandrel means from said blade means.

2. The apparatus of claim 1 wherein said blade means is adjustably mounted so that the extent to which its lower end projects under said carrier means can be established as desired.

3. The apparatus of claim 2 wherein said carrier means also comprises a well in which said blade means is located.

4. The apparatus of claim 3 wherein said well includes at least one wall portion having an opening therein and wherein said upper portion of said blade includes plural openings therein, said openings being at various heights, said apparatus additionally comprising pin means for insertion in said opening in said wall portion and in one of said openings in said blade means to establish the position of said blade means.

5. The apparatus of claim 1 wherein said blade means comprises a pair of members projecting outward from said blade means adjacent the lower end thereof to guide the blade means downward as the apparatus traverses said water or marsh.

6. The apparatus of claim 1 wherein said releasable securement means comprises an elongated shaft extending downward along said blade means, said actuating member comprising crank means connected to said shaft adjacent the top thereof, said shaft having coupling means located adjacent the bottom thereof, said coupling means being arranged to secure said mandrel means to said shaft when said coupling means is in a locked position and to release said mandrel means when said coupling means is in a released position, said shaft being rotatable by said crank means to move said coupling means to either said locked or released positions.

7. The apparatus of claim 6 wherein said releasable securement means also comprises swivel means connected to said mandrel means and having an opening therein through which a portion of said shaft adjacent said threads passes, whereupon when said crank means is moved to the released position the swivel means is uncoupled from said shaft.

8. The apparatus of claim 7 wherein said blade means is adjustably mounted so that the extent to which its lower end projects under said carrier means can be established as desired.

9. The apparatus of claim 8 wherein said carrier means also comprises a well in which said blade means is located.

10. The apparatus of claim 9 wherein said well includes at least one wall portion having an opening therein and wherein said upper portion of said blade includes plural openings therein, said openings being at various heights, said apparatus additionally comprising pin means for insertion in said opening in said wall portion and in one of said openings in said blade means to establish the position of said blade means.

11. The apparatus of claim wherein blade means comprises a pair of members projecting outward from said blade means adjacent the lower end thereof to guide the blade means downward as the apparatus traverses said ground.

12. The apparatus of claim 1 wherein said carrier means comprises a floating sled which is arranged to be towed in either a first direction across said water or marsh or in a second and opposite direction across said water or marsh.

13. The apparatus of claim 12 wherein said carrier means also comprises a well in which said blade means is located.

14. The apparatus of claim 13 wherein said blade means can be mounted in said well pointing in either said first or said second directions.

15. The apparatus of claim 14 wherein said blade means is adjustably mounted in said well so that the extent to which its lower end projects under said carrier means can be established as desired.

16. The apparatus of claim 15 wherein said well includes at least one wall portion having an opening therein and wherein said upper portion of said blade includes plural openings therein, said openings being at various heights, said apparatus additionally comprising pin means for insertion in said opening in said wall portion and in one of said openings in said blade means to establish the position of said blade means.

17. The apparatus of claim 16 said blade means comprises a pair of members projecting outward from said blade means adjacent the lower end thereof to guide the blade means downward as the apparatus traverses said ground.

18. The apparatus of claim 12 wherein said releasable securement means comprises an elongated shaft extending downward along said blade means, said actuating member comprising crank means connected to said shaft adjacent the top thereof, said shaft having coupling means located adjacent the bottom thereof, said coupling means being arranged to secure said mandrel means to said shaft when said coupling means is in position and to release said mandrel means when said coupling means is in a released position, said shaft being rotatable by said crank means to move said coupling means to either said locked or released positions.

19. The apparatus of claim 17 wherein said releasable securement means also comprises swivel means connected to said mandrel means and having an opening therein through which a portion of said shaft adjacent said threads passes, whereupon when said crank means is moved to the released position the swivel means is uncoupled from said shaft.

* * * * *